US006079504A

United States Patent [19]

Kendall

[11] Patent Number: 6,079,504

[45] Date of Patent: Jun. 27, 2000

[54] UNDERGROUND MINING DRILL RIG WITH SAFETY INTERLOCK

[75] Inventor: John Robert Kendall, Northam, South Africa

[73] Assignee: Northam Platinum Limited, South Africa

[21] Appl. No.: 09/059,328

[22] Filed: Apr. 13, 1998

[30] Foreign Application Priority Data

Apr. 11, 1997 [ZA] South Africa ..... 97/3100

[51] Int. Cl.[7] ..... E21C 11/00

[52] U.S. Cl. ..... 173/32; 173/35; 173/37; 173/52; 173/189

[58] Field of Search ..... 173/184, 31, 34, 173/35, 36, 37, 52, 46, 188, 189; 248/647; 299/33

[56] References Cited

U.S. PATENT DOCUMENTS

| | | | |
|---|---|---|---|
| 792,288 | 6/1905 | Prellwitz | 173/35 |
| 1,098,014 | 5/1914 | Carter | 248/647 |
| 2,194,466 | 3/1940 | Cadwallader | 173/35 |
| 2,415,205 | 2/1947 | Gartin | 248/647 |
| 2,500,931 | 3/1950 | Curtis | 248/647 |
| 2,623,739 | 12/1952 | Thomas et al. | 173/184 |
| 2,711,305 | 6/1955 | Henkel | 173/35 |
| 2,734,724 | 2/1956 | Larcen | 173/52 |
| 2,870,994 | 1/1959 | Klapka | 173/34 |
| 3,399,734 | 9/1968 | Folinsbee | 173/34 |
| 3,529,680 | 9/1970 | Nardone et al. | 173/35 |
| 3,957,124 | 5/1976 | Desourdy | 173/52 |
| 4,098,538 | 7/1978 | Hilton | 173/35 |
| 4,158,520 | 6/1979 | Prebensen | 173/31 |
| 5,647,442 | 7/1997 | Lange | 173/184 |

*Primary Examiner*—Peter Vo
*Assistant Examiner*—Jim Calve
*Attorney, Agent, or Firm*—Hamilton, Brook, Smith & Reynolds, P.C.

[57] ABSTRACT

A drill rig is provided which has a mobile trolley having a telescopically extendible post for locking it in position relative to the hanging wall in an underground mine. The post supports in articulated manner, at least one and generally two vertically and laterally spaced drill booms adjustable in position at least within limits relative to the height of the post. A third drill boom may operatively be supported by the trolley itself in a lower-most position. The trolley is preferably supported on driven wheels and the drills, post, and any drive motors are preferably hydraulically driven by high pressure water.

10 Claims, 4 Drawing Sheets

UNDERGROUND MINING DRILL RIG WITH SAFETY INTERLOCK

FIELD OF THE INVENTION

This invention relates to a drill rig particularly adapted for use in underground mines for the purpose of drilling holes in rock or ore being mined, usually for the purpose of blasting, but which may be for another purpose such as accommodating anchor bolts or the like.

More specifically, the invention is concerned with a drill rig particularly designed to facilitate the drilling of blast holes in a predetermined pattern at a stope face, but the invention is not to be interpreted as being limited to that particular application.

BACKGROUND TO THE INVENTION

In underground mining operations in which a blasting technique is used for shattering and breaking out an ore body, the blast holes have to be drilled in a stope face, for example, in a predetermined pattern.

Current practice for drilling with a drill rig is to employ hydraulic drills using hydraulic motors powered by an hydraulic power pack in turn energised by an electrical power supply. Not only is the power pack extremely heavy, cumbersome and difficult to move around a stope, and in particular from one stope to the next, but the current form of drill rig is also regarded by applicant as being unsatisfactory.

A hand held water driven drill will typically comprise a drill supported, in articulated manner, at the upper end of a generally inclined and manually manipulated thrust leg which is hydraulically and telescopically extensible with a grip-affording foot at its lower end.

In order to use one of these drills, two persons are required, one in order to locate the end of the drill relative to the rock face until it becomes collared, and the other to manipulate the drill boom and thrust leg so that the drill adopts the correct orientation and, in particular, axial direction.

The pattern of holes to be drilled may be of many different types, but a typical one would include three vertically spaced rows of equally spaced holes with the holes of the middle row being offset from those in the upper and lower rows by approximately one half of the distance between any two holes in a row. Some holes need to be drilled rather close to the extremities of the stope and drilling these holes, in particular, is extremely difficult, particularly with regard to collaring the drill.

It is also extremely difficult to ensure that all the adjacent holes in a row are parallel to each other due to the adjustments available on each boom.

The current drill rigs for use in stopes generally comprise one or two booms which are hydraulically adjusted to the correct position. The associated electrohydraulic power pack is generally an integral part of the rig and must move with it. The boom is generally telescopic so that once it is in position it must be moved forward to butt up against the rock face for support before drilling takes place. Because the booms are fully adjustable, the rock face must be marked so that the position of each hole is indicated before the time. The direction and dip of the hole must also be indicated because of the infinite adjustment and thus operator discretion.

Furthermore, the present mechanism for transmitting movement from the hydraulic piston and cylinder to the drill unit itself to move same along the boom, is not entirely satisfactory. In the existing arrangement a piston and cylinder is located beneath, or at least offset from, but parallel to, the path of movement of the drill unit and movement is transferred to the drill unit by way of a cable or chain passing over a pulley at the end of the boom remote from the rock face being drilled.

OBJECT OF THE INVENTION

It is the object of this invention to provide a drill rig which will provide a number of advantages over the prior art drill rigs described above and which can be used with particular advantage to drill a pattern of blast holes in a working face.

SUMMARY OF THE INVENTION

In accordance with this invention there is provided a drill rig comprising a mobile base carrying an upwardly extending telescopically extensible post for engagement with a hanging wall in an underground mine and at least one drill boom having a drill unit movable longitudinally along it, the boom being supported by the post in a manner enabling the boom to be adjusted suitably for drilling holes using the drill.

Further features of the invention provide for the mobile base to be in the form of a wheeled trolley adapted to be moved along what are usually temporary rails traversing the working face of a stope; for the wheels of the wheeled trolley to be driven wheels for moving the trolley and preferably wheels adapted to be driven in unison by a single motor through suitable transmission means; for the post to carry two or three separate drill booms with associated drill units; and, in particular, for the support to carry two vertically spaced and laterally offset drill booms with a third drill boom being carried by the carriage itself in a lowermost position.

It is a still further and important feature of the invention that each drill boom comprise a carriage supporting the drill unit and movable along the length of a track extending along the length of the boom, and wherein the carriage is attached to one end of an elongate operating piston and cylinder assembly whereof the other end is attached to the remote end of the boom, the point of connection of the piston and cylinder to the carriage being forward of the drill unit.

A still further feature of the boom is that, at its forward end, it carries a guide plate having an aperture for guiding a drill rod during the collaring process of a drill hole.

As an alternative to the driven wheels on the trolley the mobile base or trolley may be rendered movable transverse to a working face by a piston and cylinder assembly co-operating with a chain secured in use, to the upper end of an inclined stope. Also, in the case of the driven wheels, a similar chain could be used as a safety chain.

In all cases an interlock mechanism is preferably provided for preventing the activation of the drive means for the mobile base whilst the post is engaged with a hanging wall.

In all uses in the implementation of this invention it is preferred that hydraulic piston and cylinder assemblies and motors etc be adapted for operation by a high pressure water supply. In such a case the interlock mechanism can simply be an interlock valve for controlling the fluid flow to the drive means.

In the case where the mobile base is a trolley with driven wheels, channel shaped temporary rails are provided in which the wheels are to move. The web of the channel preferably has traction affording formations conveniently provided by an inset plate and the wheels preferably have elastomeric treads.

In order that the above and other features of the invention may be more fully understood, one embodiment thereof will now be described with reference to the accompanying drawings.

DETAILED DESCRIPTION WITH REFERENCE TO THE DRAWINGS

Figure 1:
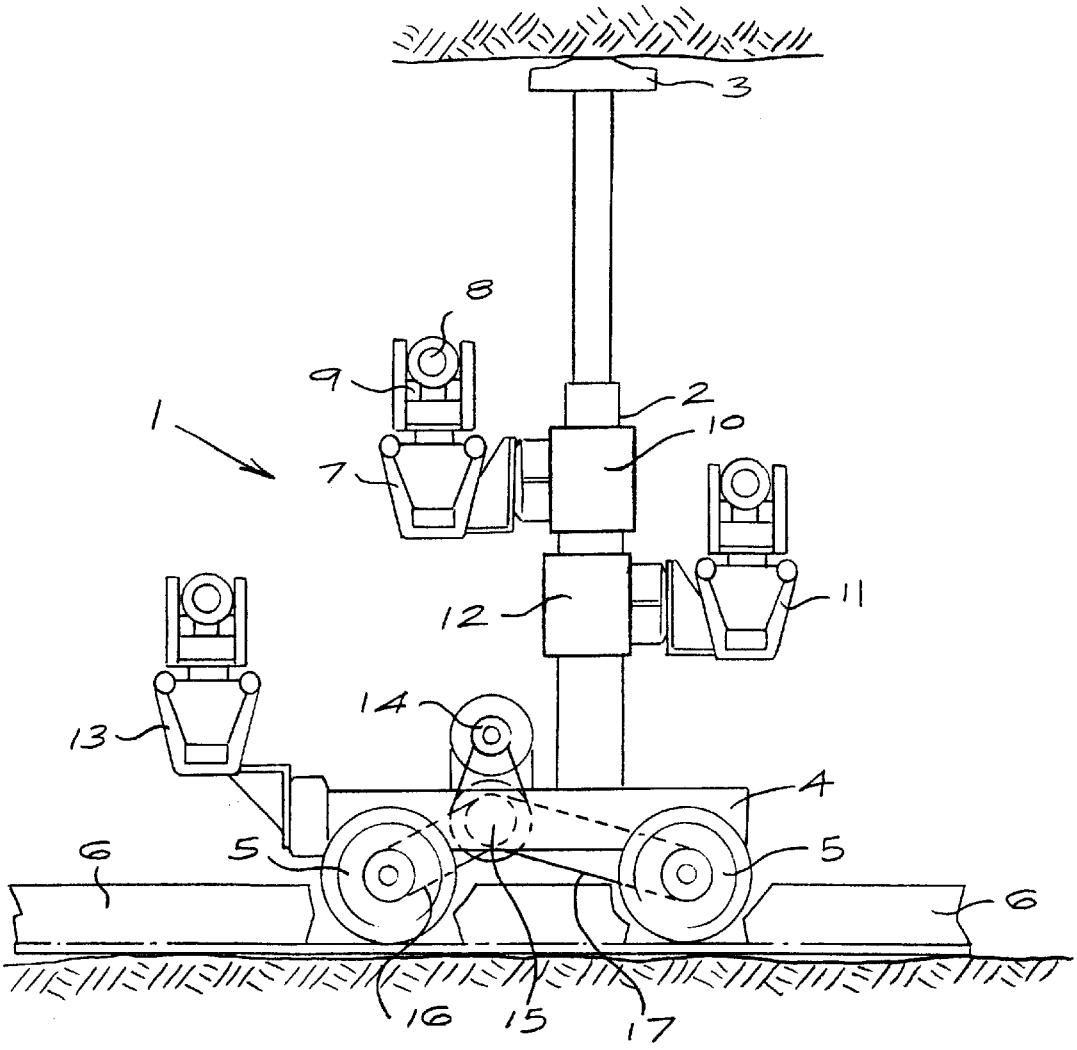
FIG.1 is a side elevation of one embodiment of the invention.
Figure 2:
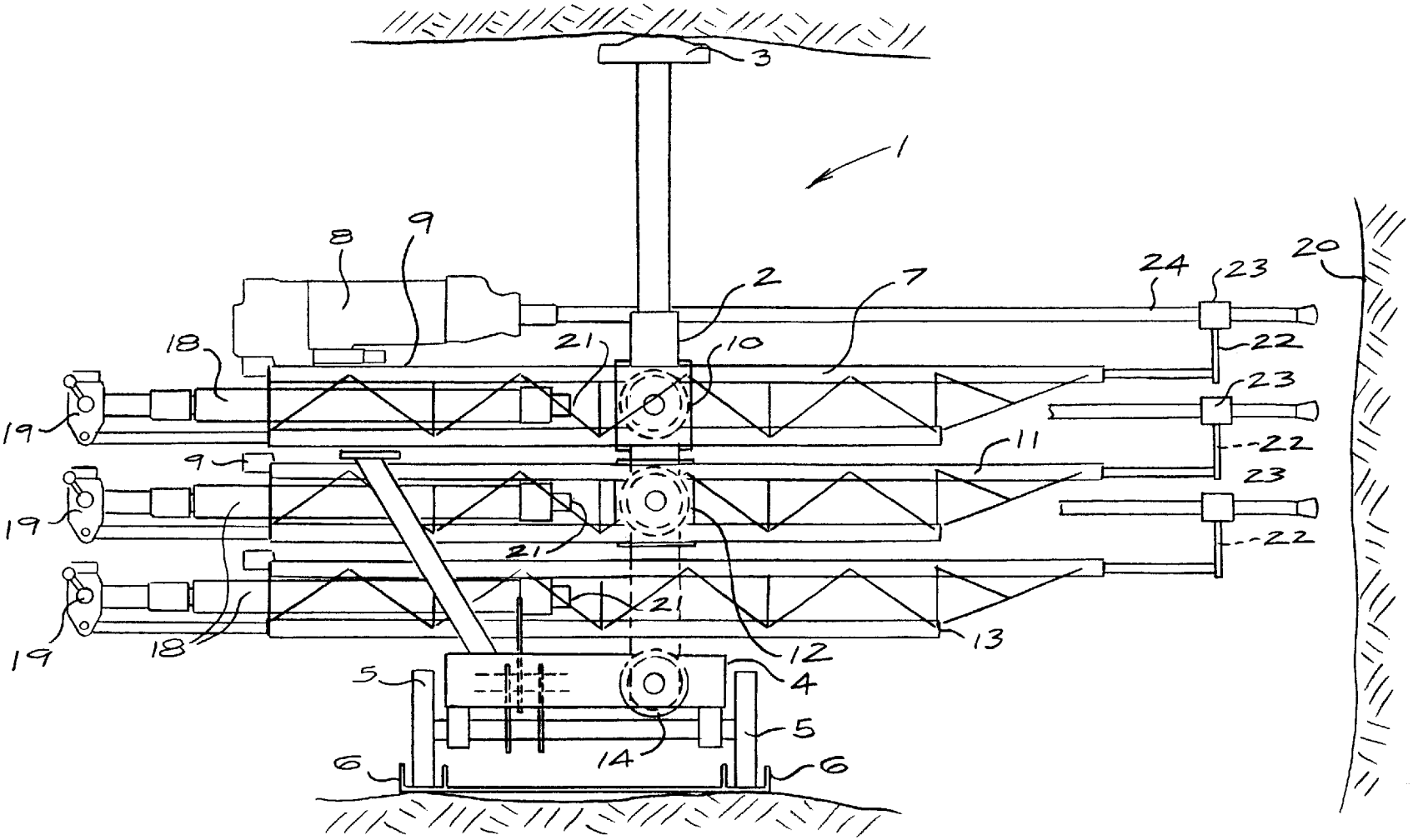
FIG.2 is a rear end view thereof.
Figure 3:
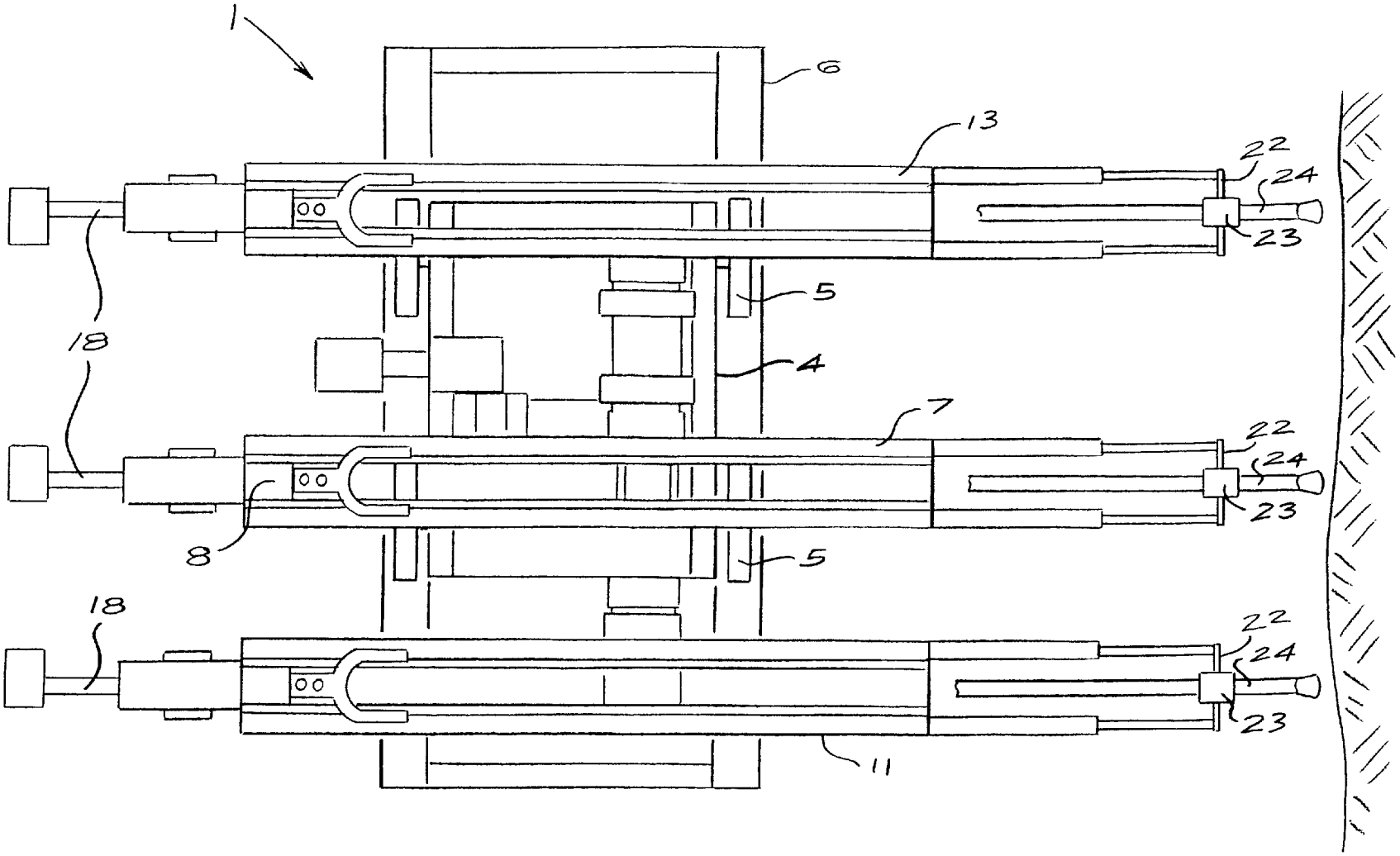
FIG.3 is a plan view thereof.

In the embodiment of the invention illustrated in the drawings a drill rig assembly, generally indicated by numeral (1), comprises an upwardly extending piston and cylinder assembly forming a telescopically extensible post (2) having a rock engaging head (3) at its operatively upper end and being mounted on a mobile base in the form of a trolley (4) at its lower end. The trolley (4) has wheels (5) adapted to co-operate with temporary rails (6) which traverse a working face in an underground mine.

The post supports an upper drill boom (7) having a drill unit (8) mounted on a carriage (9) movable longitudinally along the length of the boom. As shown most clearly in FIG. 1, this boom (7) is located to one side of the post and is carried by the post through an adjustable collar (10) which can be adjustably positioned up the height of the post within limits.

A second, and intermediate boom (11) is carried similarly by way of a collar (12) on the opposite side of the post (2) and is vertically adjustable in the mid-height area of the post.

Finally, a third boom (13) is located offset from the upper boom, but on the opposite thereof relative to the intermediate boom (11) and is carried by the trolley.

Clearly, the upper drill boom (7) is adapted to drill an uppermost row of holes; the intermediate one a middle row of holes and the lower one (13) a lower row of holes. The spacing of the booms in plan view is chosen to provide the required pattern when the trolley is moved by a predetermined distance along the rails which corresponds to the distance between two adjacent holes of a row. This can be of the order of a metre, for example.

In this embodiment of the invention movement of the trolley is achieved by driving all four wheels (5) by a hydraulic motor (14) which, through a suitable transmission (15) and drive chains (16) and (17) drives the axles on which the two pairs of wheels (5) are fixed. In this case the wheels have treads made of elastomeric material on the outer periphery which engage in the web of channel shaped temporary rails (6). The web can be provided with an inset having formations on its surface for affording traction as may be required in the circumstances that, generally speaking, a trolley of this nature will have to move up and down inclined stopes.

In this embodiment of the invention the motor, the drills, and the post are adapted to be activated by hydraulic fluid and more particularly by high pressure water. In such a case the controls for fluid flow include an interlocking valve arrangement to prevent activation of the motor (14) whilst the post is extended and in engagement with a hanging wall. In this way serious damage will be avoided.

As an alternative to driving the wheels a horizontal piston and cylinder assembly may be embodied in the trolley so that it can be attached to a chain, for example, anchored at its other end to the upper end of an inclined stope, for example, and the trolley can be moved upwardly or downwardly, as the case may be, by operating the drive piston and cylinder assembly by one stroke to move the trolley by the required predetermined distance. Alternatively, one of the working piston and cylinder assemblies described below could be used for this purpose.

As indicated above, each drill boom has a working piston and cylinder assembly (18) attached at its end (19) remote from the rock face (20) being drilled, in use, with the opposite end (21) being attached to the front end of the carriage (9) carrying the drill unit (8). By carefully selecting the position of the front end point of attachment to the carriage, relative to the drill itself, a direct drive is possible thereby overcoming the disadvantages and inconveniences of the arrangement whereby a cable or chain had to pass around a pulley at the end of the boom.

Furthermore, each boom has, at its front end, a guide plate (22) having a collar (23) therethrough for guiding the drill rod (24) during the collaring process. The guide plate (22) is adapted to be in close proximity to the rock face during this process by positioning the guide rails a predetermined distance from the rock face.

Clearly, all three drill booms are substantially identical in construction.

Figure 4:
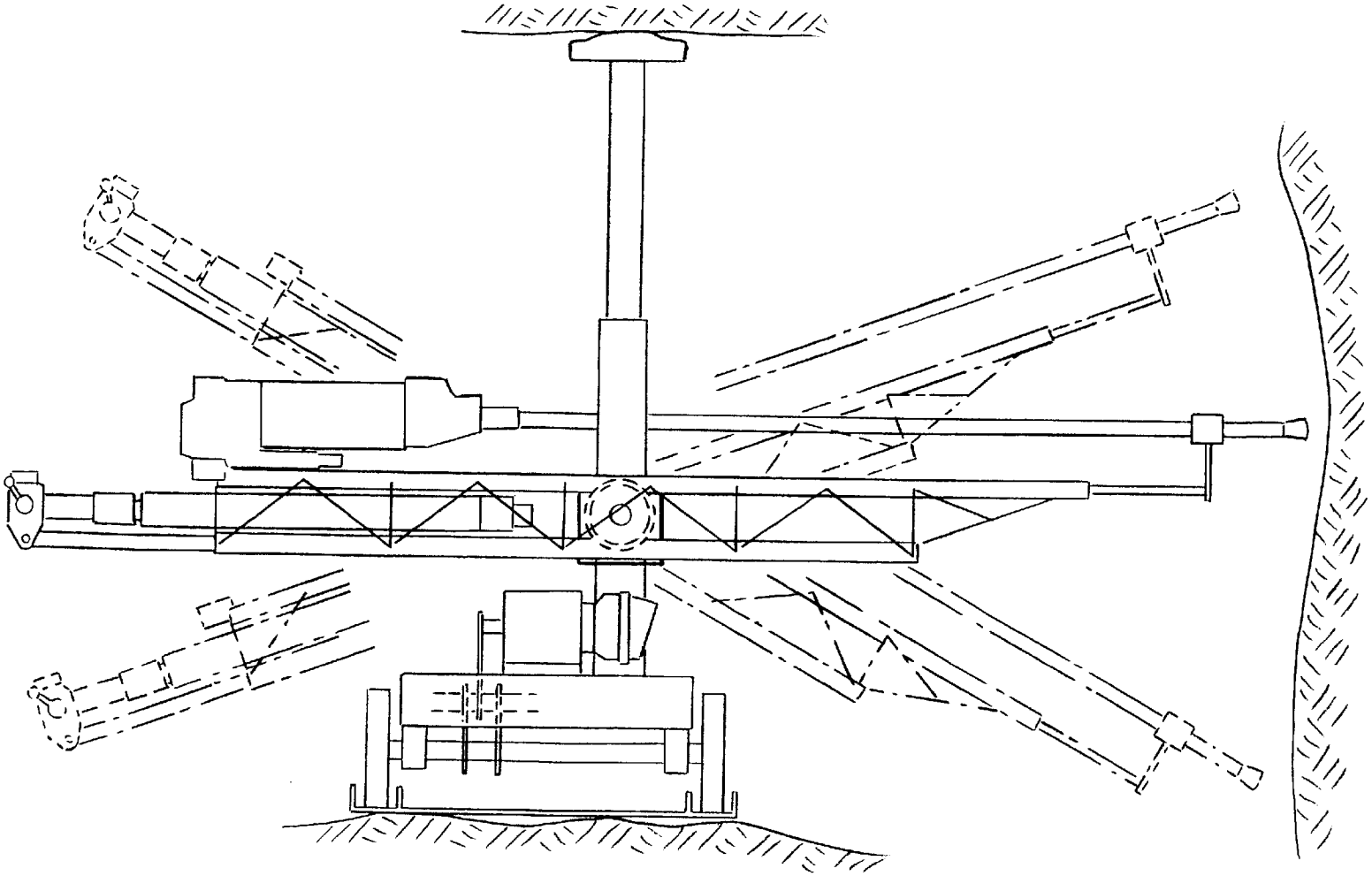
FIG.4 illustrates in side view the articulation of one drill boom.

It will be understood that, in use, the trolley is initially moved to its required position and the piston and cylinder constituting the post are extended to engage the hanging wall and thereby lock the trolley in position. Each of the drills can then be adjusted to its required height; adjusted to the required axial orientation as illustrated in FIG. 4; and operated consecutively so that the three holes can be drilled substantially simultaneously using only one operator instead of what would otherwise have required three operators.

In all uses the necessity of a hydraulic power pack is obviated by the use of high pressure water as the operating hydraulic fluid.

When the set of three holes has been completed, the motor (14) is activated after disengagement of the post and the whole rig is moved by the distance required between two adjacent holes of a row. The process is then repeated.

A substantial advantage of the drill rig described above is the fact that it lends itself to a modular type of construction. Each of the components being the drill booms, trolley, post etc. can be easily and swiftly replaced individually as and when necessary.

It will be understood that the invention is not limited in scope to the embodiment described above and will be varied in many ways. In particular, the post may only support one drill boom and the drill boom carried by the trolley itself may be omitted. Also, operation by hydraulic fluid is not essential.

It will be understood that use of the invention described above will overcome, at least to a substantial extent, most of the disadvantages outlined above and which are associated with the prior art. Also, numerous variations may be made to the embodiment of the invention described without departing from the scope hereof.

What I/we claim as new and desire to secure by Letters Patent is:

1. A drill rig comprising a mobile base carrying an upwardly extending telescopically extensible post of adjustable length for engagement with a hanging wall in an underground mine, at least one drill boom having a drill unit movable along a longitudinal axis of said boom, the boom being supported by the post through an adjustable collar which connects the boom to the post and which can be adjustably positioned along a portion of the length of the post in a manner enabling the boom to be adjusted suitably at different heights for drilling holes using the drill, drive means for driving the mobile base, and wherein an interlock mechanism is provided for preventing the activation of said drive means for the mobile base whilst the post is engaged with a hanging wall and wherein the drive means for the mobile base includes a transmission means and a fluid operated motor; the post is extendible by fluid pressure, and the interlock mechanism is an interlock valve that controls a supply of pressure fluid to the drive motor thereby isolating the motor from the supply of pressure fluid whilst the post is supplied with fluid under pressure.

2. A drill rig as claimed in claim 1 in which the mobile base is in the form of a trolley supported on wheels.

3. A drill rig as claimed in claim 2 in which the wheels of the trolley are driven wheels connected to said drive motor by way of said transmission means.

4. A drill rig as claimed in claim 1 in which the post carries two or three separate drill booms and associated drill units.

5. A drill rig as claimed in claim 4 in which the post carries two vertically spaced and laterally offset drill booms.

6. A drill rig as claimed in claim 1 in which the mobile base supports an additional drill boom independently of that or those supported by the post, such drill boom being operatively lower-most.

7. A drill rig as claimed in claim 1 in which each drill boom comprises a carriage supporting the drill unit and movable along the length of a track extending along the length of the boom, and wherein the carriage is attached to one end of an elongate operating piston and cylinder assembly whereof the other end is attached to the remote end of the boom, the point of connection of the piston and cylinder to the carriage being forward of the drill unit.

8. A drill rig as claimed in claim 1 in which each boom carries at its forward end a guide for guiding a drill rod during a collaring process.

9. A drill rig as claimed in claim 1 in which the post and drill units are all hydraulically operable.

10. A drill rig as claimed in claim 11 in which the post and drill units are operable by a supply of high pressure water.

* * * * *

UNITED STATES PATENT AND TRADEMARK OFFICE

CERTIFICATE OF CORRECTION

PATENT NO. : 6,079,504
DATED : June 27, 2000
INVENTOR(S) : Robert John Kendall

It is certified that error appears in the above-identified patent and that said Letters Patent is hereby corrected as shown below:

In the first line of Claim 10: Delete "A drill rig as claimed in claim 11" and insert therefor --A drill rig as claimed in claim 9--.

Signed and Sealed this

Third Day of April, 2001

*Attest:*

Nicholas P. Godici

NICHOLAS P. GODICI

*Attesting Officer*

*Acting Director of the United States Patent and Trademark Office*